United States Patent [19]

Eberdt et al.

[11] Patent Number: 4,662,128

[45] Date of Patent: May 5, 1987

[54] CONVERTIBLE PARTITION WALL

[76] Inventors: Jurgen Eberdt, Hindenburgstrasse 1, 7141 Moglingen; Kurt Fezer, Kornblumenweg 1, 7125 Kirchheim/Neckar; Hans Peters, Panoramastrasse 39, 7052 Schwailheim, all of Fed. Rep. of Germany

[21] Appl. No.: 784,015

[22] Filed: Oct. 4, 1985

[30] Foreign Application Priority Data

Oct. 25, 1984 [DE] Fed. Rep. of Germany ... 8431406[U]
May 28, 1985 [DE] Fed. Rep. of Germany ..... 3519061

[51] Int. Cl.[4] ..... E04B 1/346

[52] U.S. Cl. ..... 52/71; 52/243; 52/243.1

[58] Field of Search ..... 52/239, 243, 238.1, 52/243.1, 71; 160/135, 351

[56] References Cited

U.S. PATENT DOCUMENTS 3,762,116 10/1973 Anderson et al. ..... 52/239
3,874,132 4/1975 Mendelow et al. ..... 52/71
3,987,838 10/1976 LaGue et al. ..... 160/351
4,020,604 5/1977 Legler et al. ..... 160/351 X
4,104,838 8/1978 Hage et al. ..... 52/239
4,129,163 12/1978 Johnson ..... 52/239 X
4,448,003 5/1984 Hasbrouck ..... 160/351 X

FOREIGN PATENT DOCUMENTS 8431406 4/1985 Fed. Rep. of Germany .

*Primary Examiner*—Carl D. Friedman
*Attorney, Agent, or Firm*—Cushman, Darby & Cushman

[57] ABSTRACT

A convertible partition wall is assembled alternately from vertical tubular supports and wall elements attachable thereto. The wall elements are fastened to the supports at least at their upper and lower edge by fastening parts. The fastening parts each grip a push-on sleeve which can be pushed onto the corresponding end of the support and on which at least two laterally projecting fastening flanges for the attachment of the wall elements are provided. A profile frame enclosing the wall elements partially engages round the adjoining supports with laterally projecting support webs.

5 Claims, 4 Drawing Figures

CONVERTIBLE PARTITION WALL

BACKGROUND OF THE INVENTION

The invention relates to a convertible partition wall comprising wall elements fastened to vertical, tubular supports.

There are numerous such types of partition wall construction; stability is imparted to them only by virtue of the fastening at the floor and the ceiling of a room.

A previous proposal for such a partition wall is described in German Gebrauchsmuster 84 31 406. With this known partition wall, plinth elements are required for fixing the partition wall to the floor and these grip the lower edges of the wall elements. The supports are screwed onto a screw pin, which is joined to a plinth element, and at their other end are clamped with respect to the ceiling by means of a screw connection. At their upper edge the wall elements are merely joined to the supports by hooks.

SUMMARY OF THE INVENTION

The present invention is based on the problem of providing an especially rigid connection between the wall elements and the supports in a partition wall of the kind mentioned in the introduction, so that an inherently stable, sound-proof partition wall is formed, in the assembly of which it is not necessary to brace the supports between the ceiling and the floor.

The invention provides a convertible partition wall comprising vertical, tubular supports, wall elements fastened to and alternating with said vertical tubular supports, profile frames engaging at least the vertical narrow sides of said wall elements, supporting flanks of each said profile frame projecting approximately parallel to the visible surfaces on opposite sides of the respective said wall element, which supporting flanks partially enclose the adjacent said support, and fastening parts provided at least at the top and bottom edges of said wall elements for the rigid connection of said wall elements with said adjacent supports.

A stable join between the supports and the wall elements is ensured by the lateral interlocking of supports and wall elements in conjunction with a rigid connection of these parts at their top and bottom sides. Specially designed fastening parts are used for this purpose, each of which comprises at least one plug-in sleeve which may be pushed from above into the corresponding end of one of the supports, and on which there are provided at least two laterally projecting fastening flanges for the attachment of the wall elements.

Such fastening parts also permit a rigid horizontal clamping between the wall elements and the supports; because vertical supporting flanks on the wall elements lie against the periphery of the supports, a gap-free, tightly sealed wall bond between the supports and the wall elements can be obtained. Where the partition walls are angled, this bond is so stable that in certain circumstances the partition wall need not even be fastened to the floor or the ceiling. The partition wall may additionally be screwed to the ceiling or the floor merely to fix its position. The fastening flanges may lie opposite one another with respect to the vertical centre line of the plug-in sleeve, or may form different angles with one another in accordance with the run of the partition wall, wherein one or more, preferably, two, fastening flanges are provided on one joining piece.

The fastening flanges may be rigidly joined to the sleeve for example, they may be welded to the peripheral surface thereof.

Advantageously, however, one fastening flange is rigidly joined to the sleeve, and the other is fastened to a swivel part mounted on the sleeve, the swivelling axis of which swivel part runs parallel to the direction in which the sleeve is pushed into the support. In the assembled position, the direction in which the sleeve is pushed in runs parallel to the vertical centre line of the sleeve, or coincides with this axis.

Provision may then be made for one fastening flange to be mounted on a cover disc secured to the sleeve, and for the other to be disposed on a rotatable disc mounted on the sleeve so as to rotate. In the case of half-height partition wall elements, or at any rate partition wall elements that are less than room height, a facility for extending the supports may be desirable. The proposed fastening parts may be adapted to this requirement in an especially simple manner by providing an upwardly projecting extension sleeve on the plug-in sleeve. In the arrangement described above where the plug-in sleeve has a cover disc and a rotatable disc, the extension sleeve is preferably welded directly to the rotatable disc.

It is advantageous for the fastening flanges to be designed as webs which radially extend the discs assigned to them and are bent over towards the plug-in sleeve, the bent-over portion serving in each case for the attachment of fastening means.

The convertible partition wall proposed according to the invention having a rigid join between the wall elements and the supports may be of single or double shell construction; in the case of double shell construction, either the supports have a larger cross-section or several supports are provided at the intersection points of the partition wall. The partition wall may be glazed or contain doors. For a sound-proof closure in respect of the ceiling and floor, lateral attachment plates running parallel to the floor or the ceiling may be used, for example in the form of covers of L-shaped cross-section, the narrower web of which lies adjacent to the ceiling or the floor. In the case of wall elements covered with textile material, these covers may be fastened in a simple manner by means of clinging-type suction connections. Particularly in the case of the single shell form of construction, the partition wall may also be constructed half-height, like the conventional room dividers, screens, adjustable walls or similar structures.

To reduce bridges for structure-borne noise, it is advantageous to sheathe the supports with a sound-proof layer, by covering them with textile material for example; at the same time, a favourable visual effect is achieved thereby, together with a non-slip engagement of the supports and wall elements.

DESCRIPTION OF THE PREFERRED EMBODIMENTS

Figure 1:
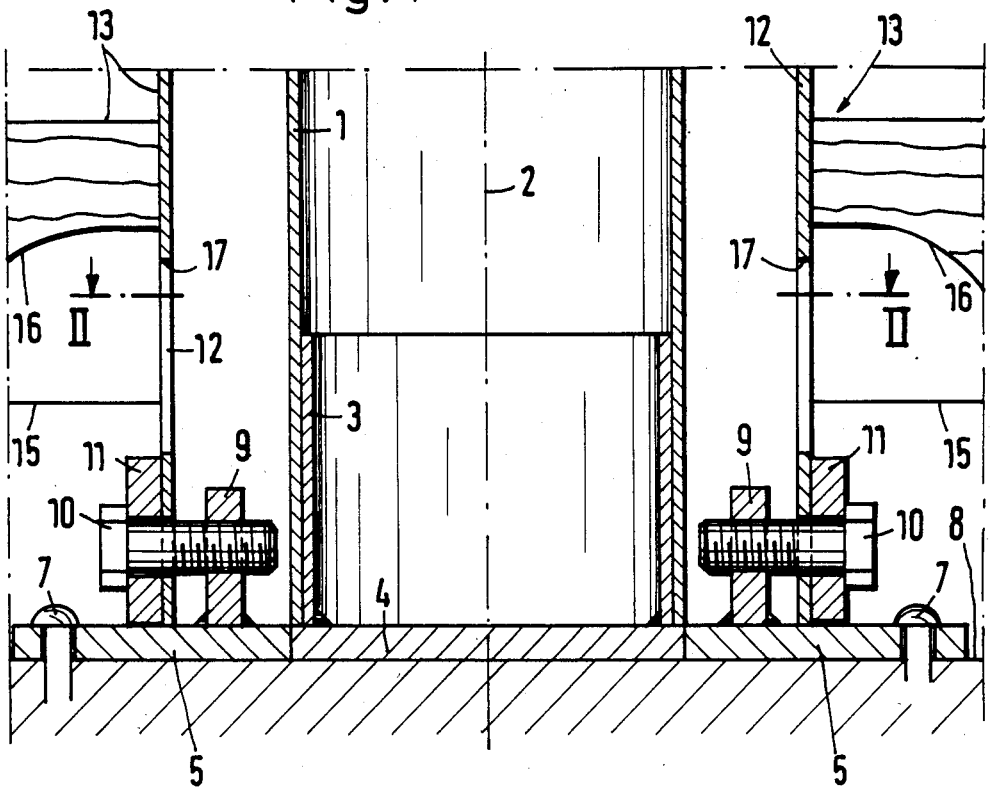
FIG. 1 shows in vertical section a part of a wall in the region of a support attached to the floor.
Figure 2:
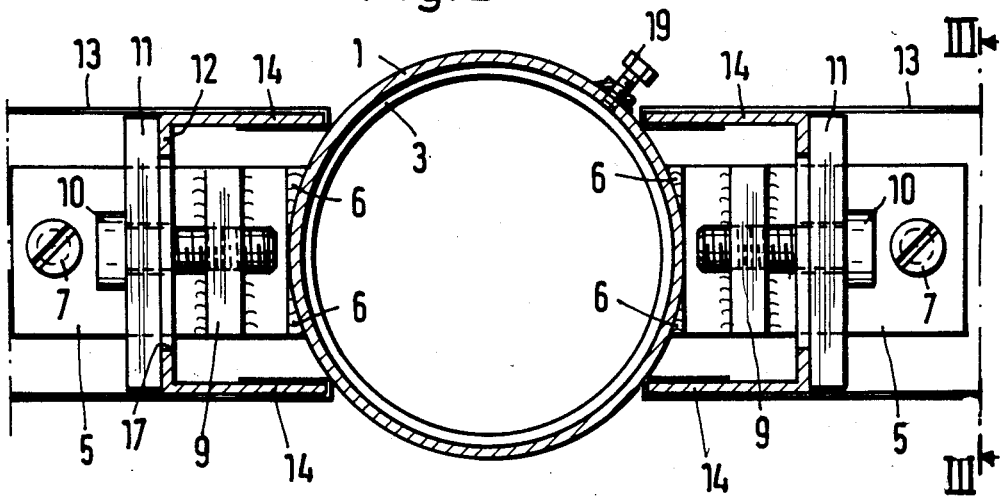
FIG. 2 is a horizontal cross-section along the line II—II of FIG. 1.

FIG. 1 shows in axial longitudinal section the lower end of a tubular support 1 having a vertical centre line 2 which simultaneously forms the centre line of a plug-in sleeve 3 of a fastening part. The plug-in sleeve 3 engages with a close sliding fit in the lower end of the support 1; it is welded onto a cover 4 that is joined on opposite sides to fastening flanges 5. The fastening flanges 5 are fixed to the outer periphery of the cover 4 by welds 6, as is more readily apparent from FIG. 2. At their free ends the fastening flanges 5 are fastened by means of screws 7 to the floor 8. Closer in towards the support 1, there are welded to the fastening flanges 5 vertical webs 9, each of which has a bore into which a respective tension screw 10 is screwed; the head of each screw is braced by way of a shim 11 against a vertically-extending, profiled web 12 of one of the wall elements 13 to be joined on.

Figure 3:
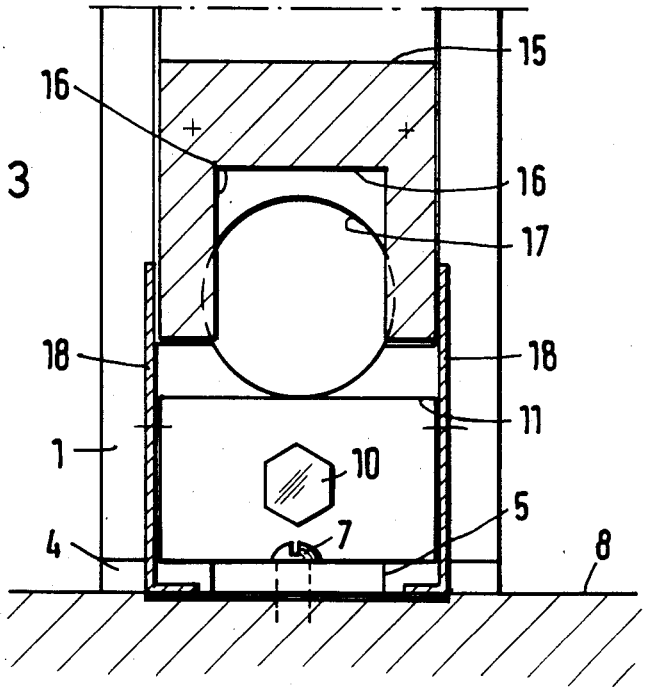
FIG. 3 is a vertical section along the line III—III of FIG. 2.

The wall elements 13 have on their vertical narrow side a U-shaped end profile open to the outside, the lateral webs of which form vertical support flanks 14, the end edges of which partially enclose the support 1 or lie against its outer periphery, the screws 10 thereby achieving a horizontal clamping. The wall elements 13 are cut away at their lower side parallel with the floor 8 so that the screws 10 can be screwed in. The packing inside the wall elements is bounded at the bottom by a frame part 15 which at its end has a central cut-out 16 that is circular in cross-section (see FIG. 1). This cut-out borders on a circular hole 17 in the adjoining vertical web 12 of the end profile of the partition wall. The hole 17 and the cut-out 16 serve for the laying of electrical leads. In the vertical section shown in FIG. 3, it can be seen that the wall element is cut away parallel to the floor, this cut-out being closed off towards the floor 8 by lateral covers 18 of L-shaped cross-section, which may be secured to the wall element by adhesive.

Figure 4:
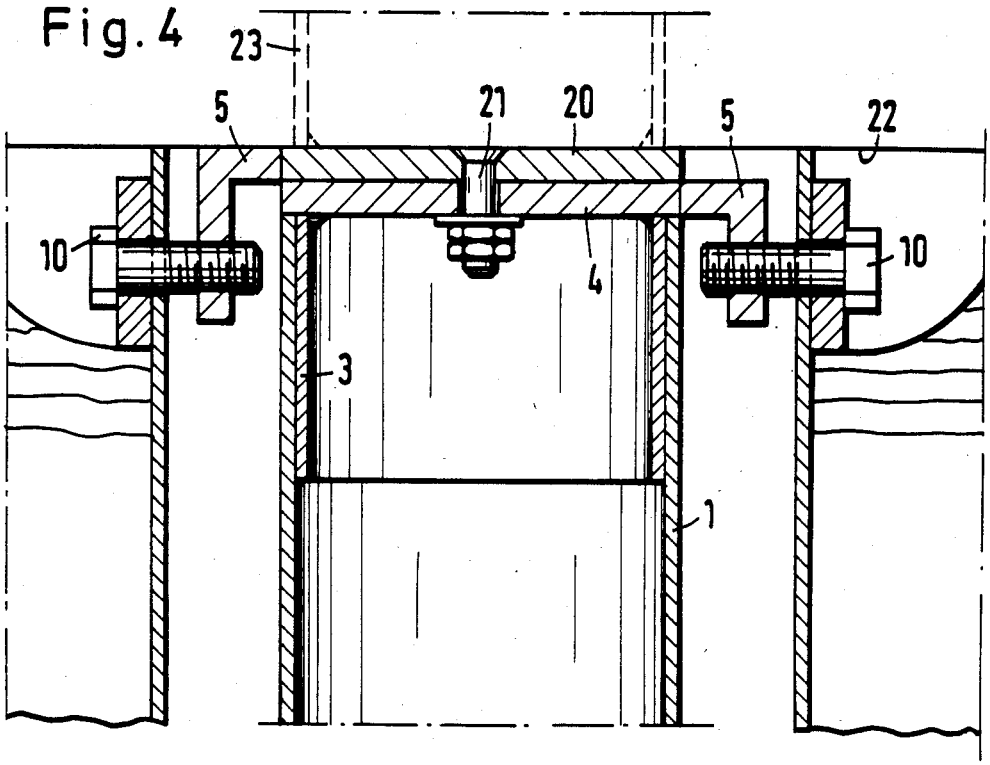
FIG. 4 shows an axial section through a fastening part placed on the upper end of a support in an alternative form of embodiment.

In place of the bore shown in the drawing for receiving the tension screw 10, the vertical web 12 of the end profile of the wall elements and the shim 11 may have slots open at the top so that insertion of the tension screw 10 is facilitated. By means of a small compression screw 19 (see FIG. 2) the plug-in sleeve 3 may be fixed in its rotational position with respect to the support 1 in order to avoid any play in the connecting region between the wall elements 13 and the supports 1. Alternatively, the compression screw 19 may additionally be located to advantage in the region of the join with the ceiling, where it can fasten the plug-in sleeve 3 if the sleeve has been slid partly out of the support 1 until it rests against the ceiling surface 22 (FIG. 4). Using this method, the distance to the ceiling can be bridged in a simple manner.

FIG. 4 shows an axial section through a support 1, in the upper end of which there is inserted a plug-in sleeve 3. The plug-in sleeve 3 is welded to a cover disc 4 on one side of which there is provided a downwardly bent fastening flange 5. Centrally on the cover disc 4 there is mounted a rotatable disc 20, a centrally positioned screw bolt 21 serving as the bearing. A further fastening flange 5 is provided on the rotatable disc 20. This arrangement enables the rotatable disc 20 to be rotated at will relative to the cover disc 4, that is to say, the partition wall can be rotated about the support to an angle. Moreover, the embodiment illustrated in FIG. 4 is designed to be compatible with the embodiment illustrated in FIGS. 1 to 3. An upwardly directed extension sleeve 23, illustrated by broken lines in FIG. 4, has the same diameter as the downwardly projecting plug-in sleeve 3. The extension sleeve 23, which is welded to the rotatable disc 20, serves to extend a half-height (for example, 1.60 m long) support 1. This facility is an especially advantageous construction variant for the transition between a room-height and a half-height partition.

While only specific embodiments of the invention have been shown, it is subject to various changes and modifications without departing from the spirit and scope of the invention as determined by the claims.

What is claimed is:

1. A convertible partition wall comprising vertical, tubular supports, wall elements comprised of opposed visible surfaces joined by vertical narrow sides, fastened to and alternating with said vertical tubular supports, profile frames engaging at least the vertical narrow sides of said wall elements, supporting flanks of each said profile frame projecting approximately parallel to said visible surfaces on opposite sides of the respective said wall element, which supporting flanks partially enclose the adjacent said vertical tubular support, and fastening parts provided at least at the top and bottom edges of said wall elements for the rigid connection of said wall elements with said adjacent vertical tubular supports, said fastening parts in each case comprising at least one plug-in sleeve which may be pushed from above onto the corresponding end of the respective said support and at least two laterally projecting fastening flanges provided on said plug-in sleeve for the attachment of said wall elements, a fastening flange extending transversely to the plug-in direction being provided on said plug-in sleeve for attachment to a ceiling or a floor, said convertible partition wall further comprising a swivel part mounted on said plug-in sleeve, the swiveling axis of which swivel part runs parallel to the direction in which said plug-in sleeve is plugged in, and wherein one said fastening flange is rigidly joined to said plug-in sleeve, and the other is fastened to said swivel part.

2. Partition wall according to claim 1, wherein a fastening flange extending transversely to the plug-in direction is provided on said swivel part for attachment to a ceiling or a floor.

3. Partition wall according to claim 1, which comprises a cover disc secured to said plug-in sleeve and a rotatable disc mounted for rotation on said plug-in sleeve, and wherein one said fastening flange is mounted on said cover disc and the other is mounted on said rotatable disc.

4. Partition wall according to claim 3, which comprises fastening means and wherein said fastening flanges are designed as webs which radially extend said discs assigned to them and are bent over towards said plug-in sleeve to form a bent-over portion, the bent-over portion serving in each case for the attachment of said fastening means.

5. Partition wall according to claim 4, wherein said wall elements are cut away along their upper and/or lower edge for the purpose of attaching said fastening means, and wherein there are provided covers for closing the cut-outs laterally.

* * * * *